US006715957B2

(12) United States Patent
Colvard et al.

(10) Patent No.: US 6,715,957 B2
(45) Date of Patent: Apr. 6, 2004

(54) PAVING APPARATUS WITH RETRACTABLE PAVEMENT FORMING ASSEMBLY

(75) Inventors: John Charles Colvard, Wilkesboro, NC (US); Orie L. Beaver, Jr., Salisbury, NC (US)

(73) Assignee: Power Curbers, Inc., Salisbury, NC (US)

( * ) Notice: Subject to any disclaimer, the term of this patent is extended or adjusted under 35 U.S.C. 154(b) by 53 days.

(21) Appl. No.: 09/981,721

(22) Filed: Oct. 17, 2001

(65) Prior Publication Data

US 2003/0072612 A1 Apr. 17, 2003

(51) Int. Cl.[7] ..... E01C 19/12
(52) U.S. Cl. ..... 404/105
(58) Field of Search ..... 404/96, 101, 105

(56) References Cited

U.S. PATENT DOCUMENTS

| | | | | | |
|---|---|---|---|---|---|
| 3,029,715 | A | | 4/1962 | Bowen | 94/46 |
| 3,175,478 | A | | 3/1965 | Smith | 94/46 |
| 3,257,917 | A | | 6/1966 | Lewis | |
| 3,264,958 | A | | 8/1966 | Babb et al. | 94/46 |
| 3,292,511 | A | | 12/1966 | Cheney | 94/46 |
| 3,359,875 | A | * | 12/1967 | Reider | 404/75 |
| 3,566,759 | A | | 3/1971 | Gurries | 94/46 |
| 3,602,113 | A | * | 8/1971 | Davin et al. | 404/84.2 |
| 3,606,827 | A | | 9/1971 | Miller et al. | 94/46 |
| 3,635,131 | A | | 1/1972 | Larsen et al. | 94/46 |
| 3,637,026 | A | | 1/1972 | Snow | 172/4.5 |
| 3,674,094 | A | | 7/1972 | Kuntz | 172/4.5 |
| 3,709,116 | A | | 1/1973 | Whitbread et al. | 94/46 |
| 3,710,695 | A | | 1/1973 | Miller et al. | 94/46 |
| 3,749,504 | A | | 7/1973 | Smith | 404/84 |
| 3,750,063 | A | | 7/1973 | Lowen et al. | 335/206 |
| 3,771,892 | A | | 11/1973 | Munyon et al. | 404/84 |
| 3,856,425 | A | | 12/1974 | Miller et al. | 404/84 |
| 3,907,451 | A | * | 9/1975 | Fisher et al. | 404/101 |
| 3,970,405 | A | | 7/1976 | Swisher, Jr. et al. | 404/105 |
| RE28,979 | E | | 9/1976 | Long et al. | 172/4.5 |
| 4,029,165 | A | | 6/1977 | Miller et al. | 180/6.48 |
| 4,081,033 | A | | 3/1978 | Bulger et al. | 172/4.5 |
| 4,159,890 | A | * | 7/1979 | Ogaki et al. | 425/59 |
| 4,197,032 | A | | 4/1980 | Miller | 404/98 |
| 4,266,917 | A | | 5/1981 | Godbersen | 425/64 |
| 4,319,859 | A | | 3/1982 | Wise | 405/268 |
| 4,323,321 | A | * | 4/1982 | Dale | 404/105 |
| 4,360,293 | A | | 11/1982 | Wade | 405/268 |
| 4,708,519 | A | * | 11/1987 | Davin et al. | 404/101 |
| 4,789,266 | A | | 12/1988 | Clarke, Jr. et al. | 404/96 |
| 4,808,026 | A | | 2/1989 | Clarke, Jr. et al. | 404/90 |
| 4,854,769 | A | | 8/1989 | Fukukawa et al. | 404/72 |
| 4,861,189 | A | | 8/1989 | Fukukawa et al. | 404/84 |
| 4,925,340 | A | | 5/1990 | Heiser et al. | 404/75 |
| 4,934,864 | A | | 6/1990 | Mauldin | 404/108 |
| 4,948,292 | A | | 8/1990 | Haven et al. | 404/84 |
| 5,009,544 | A | * | 4/1991 | Chaize | 404/72 |
| 5,009,546 | A | | 4/1991 | Domenighetti et al. | 404/110 |
| 5,044,820 | A | | 9/1991 | Prang | 404/84 |
| 5,101,360 | A | | 3/1992 | Bennett | 364/505 |
| 5,102,267 | A | * | 4/1992 | Bell et al. | 405/268 |
| 5,201,603 | A | | 4/1993 | Bassett et al. | 404/84.1 |

(List continued on next page.)

*Primary Examiner*—Gary S. Hartmann
(74) *Attorney, Agent, or Firm*—Kennedy Covington Lobdell & Hickman, LLP

(57) ABSTRACT

In a slip-form paving apparatus, a forwardly disposed pavement forming assembly, such as an auger assembly and a strike-off plate, are pivotably mounted to the apparatus frame for movement between an operative disposition disposed adjacent a ground surface for distributing and forming paving material thereon generally into a desired form of pavement and an inoperative position more elevated from the ground surface for permitting access beneath the apparatus for depositing a starting quantity of the paving material during an initial start-up of the apparatus.

16 Claims, 2 Drawing Sheets

U.S. PATENT DOCUMENTS 5,356,238 A 10/1994 Musil et al. ..... 404/84.1
5,362,176 A 11/1994 Sovik ..... 404/72
5,362,178 A 11/1994 Schantz ..... 404/101
5,401,115 A 3/1995 Musil et al. ..... 404/72
5,529,434 A 6/1996 Swisher, Jr. ..... 404/108
5,531,542 A * 7/1996 Willis ..... 404/101
5,549,412 A 8/1996 Malone ..... 404/84.1
5,568,992 A 10/1996 Grembowicz et al. ..... 404/101
5,590,977 A 1/1997 Guntert et al. ..... 404/101
5,599,134 A 2/1997 Macku et al. ..... 404/84.1
5,662,431 A 9/1997 Colvard ..... 404/105
5,735,634 A 4/1998 Ulrich et al. ..... 404/102
5,851,085 A 12/1998 Campbell ..... 404/75
5,879,104 A * 3/1999 Ulrich ..... 404/102
6,109,825 A 8/2000 Yon ..... 404/84.05
6,129,481 A 10/2000 Tapio et al. ..... 404/102
6,152,649 A * 11/2000 Snyder et al. ..... 404/101
6,183,160 B1 2/2001 Tapio et al. ..... 404/84.1
6,390,727 B1 * 5/2002 Guntert, Jr. et al. ..... 404/88

* cited by examiner

PAVING APPARATUS WITH RETRACTABLE PAVEMENT FORMING ASSEMBLY

BACKGROUND OF THE INVENTION

The present invention relates generally to apparatus for forming concrete or other flowable paving material into a paved surface and, more particularly, to such a paving apparatus of the self propelled type for continuous slip-form paving of roadways, sidewalks and like concrete pavement surfaces.

Self-propelled construction vehicles and other construction equipment of diverse types are well known. One type of such construction equipment are so-called slip-form paving machines essentially adapted to continuously form concrete or another flowable paving material along the ground or other base surface, for example, to form a roadway. Diverse forms of such machines have been described in prior patents, representative examples of which may be found in U.S. Pat. Nos. 3,175,478; 3,264,958; 3,637,026; 3,771,892; 3,970,405; 4,197,032; 4,360,293; 4,925,340; 4,948,292; 5,044,820 and 5,590,977.

Conventionally, it is commonplace for paving equipment of this type to support the machine frame on a plurality of drivable transport assemblies, such as so-called crawler track assemblies, adapted to facilitate steerable driving of the paving machine over substantially any ground surface along which a roadway or like surface is to be paved. The frame of the machine is equipped with various devices and mechanisms to perform various functions of the paving operation, including typically an auger or other suitable mechanism for distributing the paving material laterally across the front of the machine, followed by a vertically disposed plate or like structural member, commonly referred to as a strike-off plate, positioned with a lower edge thereof at a desired elevation with respect to the ground surface to be paved to control the amount of paving material passing thereunder and thereby to initially form the material generally as a slab of the desired thickness, and then followed by a substantially horizontally disposed undersurface, commonly referred to as a screed, for purposes of leveling and finishing the concrete material.

In basic operation, a continuous supply of concrete or other suitable paving material is deposited in front of the paving machine between its transport assemblies as the machine is driven over the intended path of the pavement surface, with the auger mechanism initially distributing the paving material laterally, after which the lower edge of the plate "strikes off" a rough slab form of a desired thickness of the concrete material which then is more precisely spread, leveled and finished by vibration devices followed by the screed.

Once such a paving machine is under operation, it is a relatively simple matter to maintain ongoing operation on a substantially continuous basis, absent any malfunctions in the machinery itself, merely by maintaining a sufficient supply of concrete in front of the advancing machine. However, the initial start-up of a paving operation, including beginning operation at the start of each work day or otherwise after a period of sufficiently extended inactivity in the paving operation by which the concrete of a previously paved section of roadway has solidified and begun to cure, requires special efforts and can be much more problematic.

Specifically, the initial start-up of a slip-form paving operation, especially when continuing the paving of a previously formed section of pavement, requires that a sufficient starting supply of concrete be deposited not only in front of the auger mechanism and the strike-off plate but also therebehind beneath the screed fully up to the previously formed section of pavement, so as to ensure that there will be no interruption in the continuity nor the quality of the pavement slab. Generally, the only reliable way of accomplishing start-up of a slip-form paving machine under such circumstances is to position the machine immediately above the previously formed section of pavement and then to have workers manually shovel and preliminarily level a sufficient quantity of new wet concrete beneath and behind the auger mechanism, the strike-off plate and the screed, in addition to depositing a supply of concrete in front of the auger mechanism, whereupon operation of the machine can begin. This process is not only labor-intensive, time-consuming, expensive and inefficient, it is also difficult to ensure that the starting portion of the new section of pavement is of comparable quality and uniformity to that of the previously-formed section.

SUMMARY OF THE INVENTION

It is accordingly an object of the present invention to provide an improved slip-form paving apparatus which will address and overcome the disadvantages of the known paving apparatus as discussed above. More particularly, it is an object of the present invention to provide a slip-form paving apparatus which will better facilitate the deposition of a supply of concrete beneath the apparatus for starting up a new paving operation.

Briefly summarized, the present invention is basically applicable to any slip-form paving apparatus having a frame supported on a steerable self-propelled transport arrangement with a pavement forming assembly or like means disposed on the frame at a forward side thereof. In accordance with the present invention, the pavement forming assembly is movable with respect to the frame between an operative position disposed relative to a ground surface to be paved for distributing and forming a paving material on the ground surface generally into a desired form of pavement and an inoperative position disposed at a greater elevation relative to the ground surface than in the operative position for permitting access beneath the frame during an initial start-up of the apparatus so as to enable a starting quantity of the paving material to be readily deposited thereat.

In a preferred embodiment, the pavement forming assembly comprises a spreading mechanism or like means for distributing paving material across the forward side of the frame, e.g., an auger mechanism, a plow-type spreader, or the like, and a strike-off member or like means for generally leveling the pavement material on the ground surface. The spreading mechanism and the strike-off member, such as a strike-off plate, are integrally mounted pivotably to the frame for pivoting movement between the inoperative and operative positions. Thus, with the pavement forming assembly pivoted or otherwise moved into its inoperative position, workers have ready access to deposit and preliminarily work a starting supply of concrete or other paving material beneath the paving apparatus behind the normal operative disposition of the spreading mechanism and the strike-off member, after which the pavement forming assembly may be pivotably moved into its operative position for beginning the paving operation.

Other details, features and advantages of the present invention will be described and understood from a detailed description of a preferred embodiment of the invention set forth below with reference to the accompanying drawings.

DETAILED DESCRIPTION OF THE PREFERRED EMBODIMENT

Figure 1:
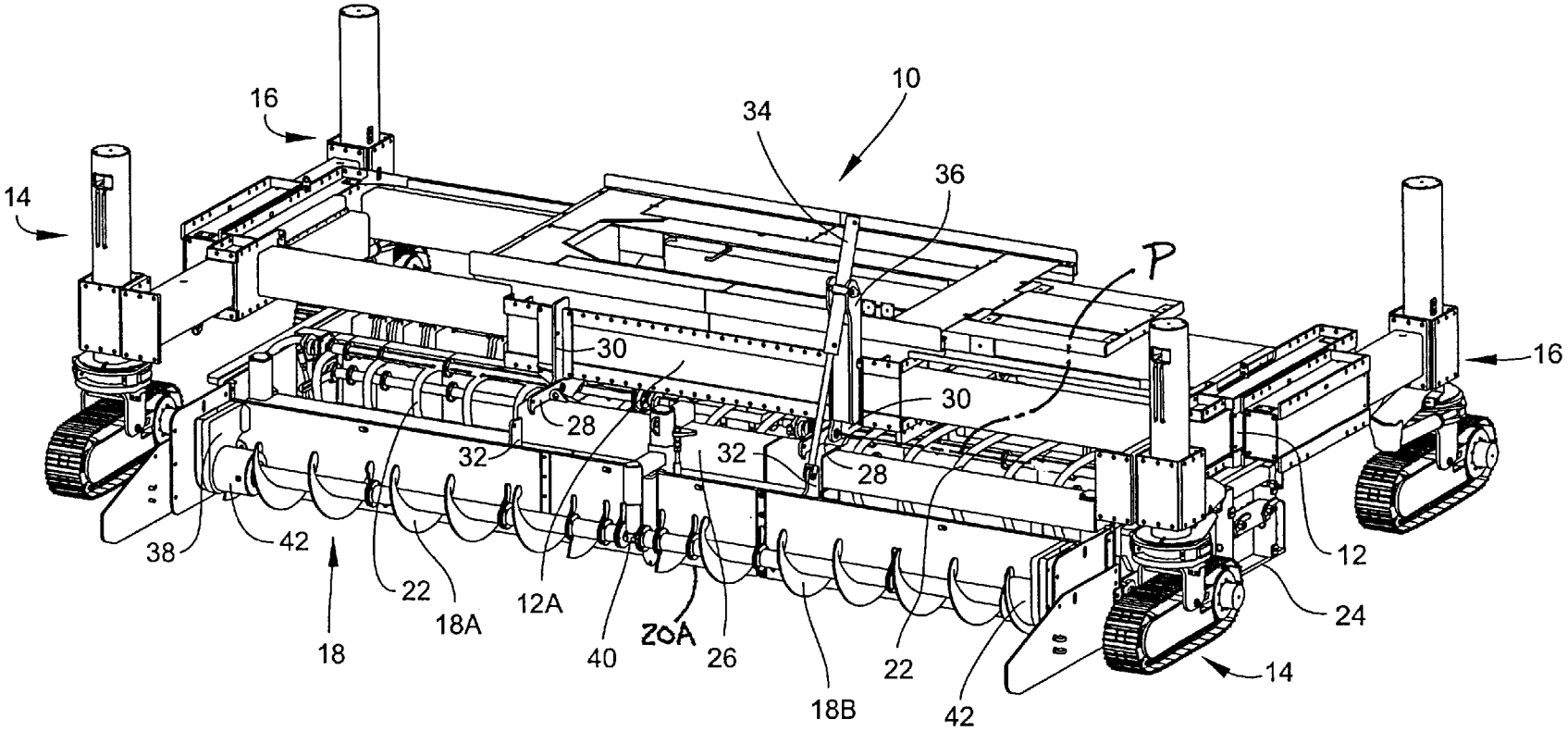
FIG. 1 is a front perspective view of a slip-form paving apparatus equipped with a retractable pavement forming assembly in accordance with the present invention, illustrating the pavement forming assembly in operative disposition.

Referring now to the accompanying drawings and initially to FIG. 1, a self-propelled slip-form paving apparatus in accordance with the present invention is indicated in its totality at 10. The paving apparatus 10 basically comprises a structural framework 12 supported substantially horizontally on four front and rear steerable transport assemblies 14, 16, each preferably comprising a so-called crawler assembly of the endless track type, disposed at the four corners of the structural framework 12 in laterally and longitudinally spaced relation to provide stable suspension of, and steering control for, the framework 12. An internal combustion engine (not shown) or other suitable self-contained power generator, preferably in conjunction with a hydraulic pump (also not shown), is mounted to the structural framework 12 to provide drive power to and steering control of the transport assemblies 14, 16, and to otherwise supply operational power to the various systems of the paving apparatus.

The embodiment of the paving apparatus 10 depicted in the accompanying drawings is particularly adapted for use in road construction for the continuous slip-form paving of a slab-type concrete roadway, the lateral width of the apparatus 10 between the front and rear transport assemblies 14, 16 being sufficient for the formation simultaneously of two road lanes side-by-side one another. However, as those persons skilled in the art will understand, the essential features and inventive concepts forming the present invention are equally well-adapted to substantially any other form of self-propelled slip-form paving apparatus.

The paving apparatus 10 is equipped with a screw-type auger assembly 18 transversely spanning the framework 12 at the forward leading side thereof, comprised of two aligned auger sections 18A, 18B each of which is selectively driveable in opposite rotational directions independently of the other auger section, for laterally distributing a supply of concrete, or another suitable flowable paving material, deposited in front of the apparatus across the ground structure over which the roadway is to be paved. However, as those persons skilled in the art will recognize, other types of mechanisms for spreading the paving material may also be utilized instead of the auger assembly, e.g., a plow-type spreader or the like. Immediately rearwardly of the auger assembly 18, a vertically disposed plate 20, commonly referred to as a strike-off plate, is supported by the framework 12 with a lower edge 20A of the plate 20 extending laterally across substantially the full width of the apparatus 10 at an elevation essentially corresponding to the desired elevation to which the roadway slab is to be paved, to act as a metering gate controlling the level of concrete material passing underneath the strike-off plate 20.

Figure 2:
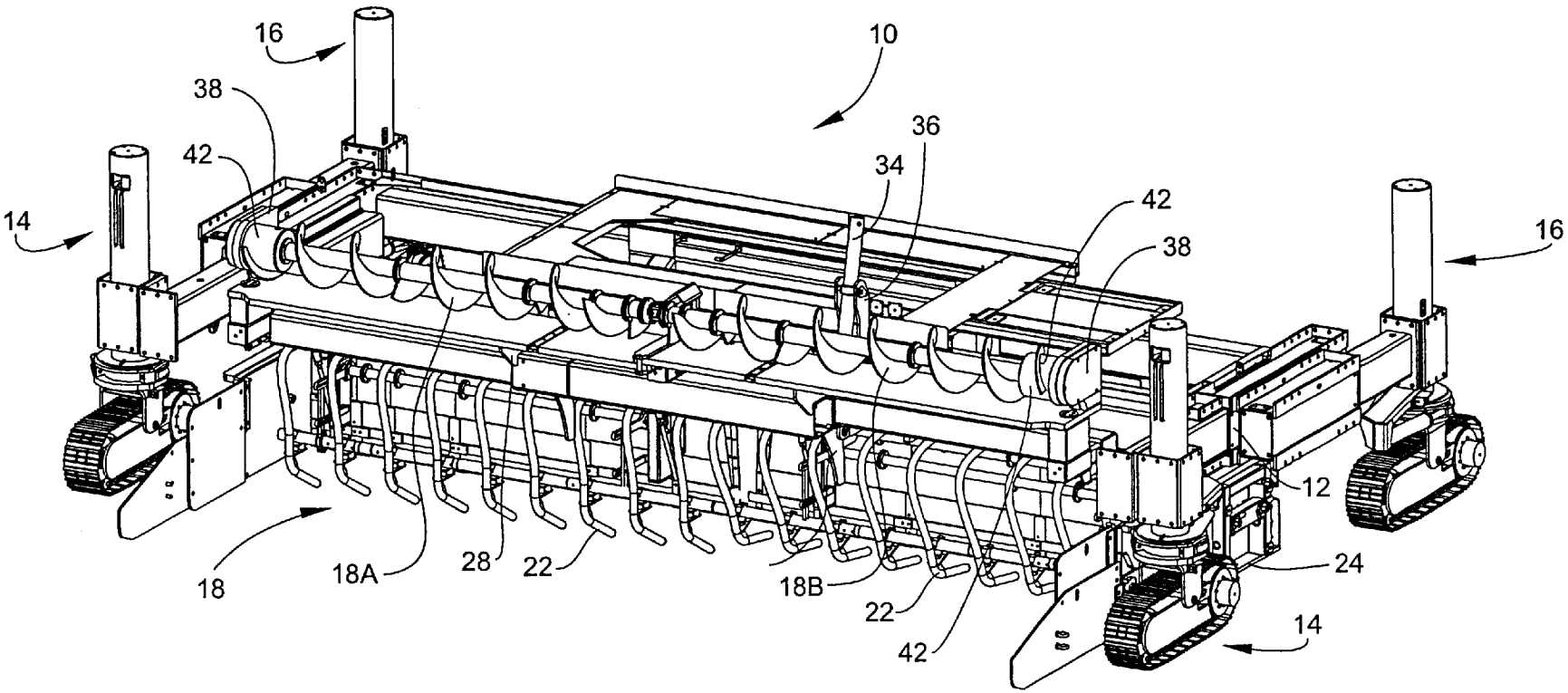
FIG. 2 is another front perspective view of the slip-form paving apparatus of FIG. 1, illustrating the pavement forming assembly in retracted disposition.

A series of vibratory devices, only partially visible at 22 in FIG. 1 but more fully shown in FIG. 2, are mounted to the framework 12 at regular spacings across the transverse width of the paving apparatus 10 immediately behind the strike-off plate 20 to further assist in the leveling and settlement of the distributed concrete material by imposing a rigorous vibratory action on the concrete material passing under the strike-off plate 20. A finish screed 24 is disposed rearwardly of the vibratory devices 22 and is preferably in the form of a substantially horizontal plate extending transversely across the width of the paving apparatus 10 and rearwardly from the vibratory devices 22.

Thus, the basic operation of the paving apparatus 10 will be understood. As the paving apparatus 10 is self-propelled via the front and rear crawler assemblies 14, 16 on the ground surface over which the roadway slab is to be formed, a suitable supply of concrete is maintained continuously in front of the auger assembly 18. The operator of the paving apparatus 10 actuates and deactuates one or both of the sections 18A, 18B of the auger assembly 18 in either direction as necessary to distribute the concrete material with general uniformity laterally across the forward side of the paving apparatus. As the paving apparatus 10 advances, the vertically-disposed plate 20 strikes off a limited amount of the concrete material and partially compacts it to a uniform density, following which the vibratory devices 22 serve to expel any air bubbles from the concrete material and to further settle and smooth the upward surface of the concrete material. As the paving apparatus 10 continues to advance forwardly, the screed 24 is then drawn over the vibrated depth of the concrete material, performing a final compacting thereof and smoothing of its upper surface.

To the extent thus far described, the basic structure and operation of the paving apparatus 10 is essentially conventional. As already described above, it will be recognized that the operative disposition of the auger assembly 18 and the strike-off plate 20 substantially closes off access to the underside of the paving apparatus 10 and makes difficult the delivery, manually or otherwise, of a suitable quantity of concrete or other paving material underneath the apparatus for start-up purposes.

Accordingly, the present invention deviates from the structure and operation of conventional paving apparatus by mounting the strike-off plate 20 pivotably to the forward side of the framework 12 for selective retraction of the strike-off plate upwardly away from its normal operative disposition. Specifically, a laterally-extending support member 26 is supported from an elevated forwardly-facing portion 12A of the framework 12 by two crank arms 28 affixed rigidly to the support member 26 at a spacing therealong and, in turn, pivotably affixed to correspondingly spaced support brackets 30 on the frame member 12A. The strike-off plate 20 is rigidly affixed to the support member 26 for depending relation therefrom in its operative disposition via a pair of bracket arms 32. Pivoting movement of the support member 26, the crank arms 28, the bracket arms 32, and the strike-off plate 20 about the pivot axis P is controlled via extension and retraction of a linear actuator 34, preferably in the form of an hydraulic piston-and-cylinder assembly 34 the cylinder body of which is mounted at an elevated disposition on the framework 12 via an upstanding mounting bracket 36, with the piston extending downwardly to a point of affixation to one of the bracket arms 32.

Additionally, in accordance with the present invention, the auger assembly 18 is affixed integrally with the strike-off plate 20 via a pair of support arms 38 extending forwardly in spaced facing relation to one another from the opposite lateral ends of the strike-off plate 22, and an intermediate support bearing 40 disposed midway therebetween. Each support arm 38 carries an hydraulic motor 42 from which a respective one of the auger sections 18A, 18B extends in alignment with the other auger section to the intermediate support bearing 40 to which each of the auger sections 18A, 18B is rotationally mounted.

The operation of the present invention may thus be understood. As a result of the mechanical arrangement described above, the auger assembly 18, the strike-off plate 20, the bracket arms 32, the support member 26, and the crank arms 28 are rigidly affixed with respect to one another for pivoting movement as a unit relative to the pivot axis P defined by the two brackets 30. With the piston-and-cylinder assembly 34 fully extended, the auger assembly and the strike-off plate unit 20 is pivoted downwardly in its normal operational disposition wherein the auger assembly 18 and the strike-off plate 20 face forwardly from the paving apparatus 10 in relatively close adjacency to the ground surface on which the paving apparatus 10 is supported, so as to operate in the normal manner already described above to distribute, compact and preliminarily level concrete material deposited in front of the paving apparatus 10 as it advances, as illustrated in FIG. 1. However, upon full retraction of the piston-and-cylinder assembly 34, the unit of the auger assembly 18 and the strike-off plate 20 is pivoted approximately 90 degrees upwardly and then rearwardly to dispose the auger assembly 18 and the strike-off plate 20 at a substantial elevated spacing from the ground surface and thereby exposing the vibratory devices 22 and the screed 24 to ready access by workers, as illustrated in FIG. 2.

Thus, with the auger assembly 18 and the strike-off plate 20 in the inoperative disposition of FIG. 2, the ability of workers to quickly and easily deposit a start-up supply of concrete, or other paving material, beneath and forward of the screed 24 behind the normal operating disposition of the auger assembly 18 and the strike-off plate 20 is greatly facilitated and simplified. Preparation of the paving apparatus 10 for beginning a new paving operation, whether at a new paving location or continuing from the terminal point of an ongoing paving operation can be accomplished with less labor and in a shorter period of time and, hence, more efficiently and less expensively than with conventional paving apparatus. Once the appropriate start-up supply of concrete has been deposited beneath the paving apparatus 10, the auger assembly 18 and the strike-off plate 20 are pivoted downwardly as a unit into their normal operative disposition via extension of the piston-and-cylinder assembly 34 to begin the paving operation. An additional benefit of the present invention is that the overall width of the paving apparatus is reduced with the auger assembly 18 and the strike-off plate 20 pivoted upwardly into the inoperative position, which achieves a narrower configuration to better facilitate over-the-road transport of the apparatus.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A slip-form paving apparatus having a frame supported on a steerable self-propelled transport arrangement and a pavement forming assembly disposed on the frame at a forward side thereof, the pavement forming assembly being pivotally movable with respect to the frame between an operative position disposed relative to a ground surface to be paved for distributing and forming a paving material on the ground surface generally into a desired form of pavement and an inoperative position angularly offset from the operative position by at least about 90 degrees and disposed by the offset at a greater, inoperable elevation relative to the ground surface than in the operative position for permitting access beneath the frame during an initial start-up of the apparatus to deposit thereat a starting quantity of the paving material.

2. A slip-form paving apparatus according to claim 1, wherein the pavement forming assembly comprises a spreader mechanism for distributing paving material across the forward side of the frame.

3. A slip-form paving apparatus according to claim 1, wherein the pavement forming assembly comprises a strike-off member for generally leveling the pavement material on the ground surface.

4. A slip-form paving apparatus according to claim 3, wherein the strike-off member comprises an edge disposed in the operative position at a predetermined elevation with respect to the ground surface to be paved.

5. A slip-form paving apparatus according to claim 4, wherein the strike-off member comprises a strike-off plate essentially vertically disposed with a depending extent of the plate forming the edge laterally with respect to the frame.

6. A slip-form paving apparatus according to claim 1, wherein the pavement forming assembly comprises an auger mechanism for distributing paving material across the forward side of the frame and a strike-off member for generally leveling the pavement material on the ground surface, the auger mechanism and the strike-off member being joined for unitary movement between the inoperative and operative positions.

7. A slip-form paving apparatus according to claim 6, wherein the auger mechanism and the strike-off member are mounted integrally with respect to one another and pivotably to the frame for unitary pivoting movement between the inoperative and operative positions.

8. A slip-form paving apparatus according to claim 1, wherein the pavement forming assembly is supported pivotably on the frame for pivoting movement between the inoperative and operative positions.

9. A slip-form paving apparatus having a frame means supported on a steerable self-propelled transport means and a pavement forming means disposed on the frame means at a forward side thereof, the pavement forming means being pivotally movable with respect to the frame means between an operative position disposed relative to a ground surface to be paved for distributing and forming a paving material on the ground surface generally into a desired form of pavement and an inoperative position angularly offset from the operative position by at least about 90 degrees and disposed by the offset at a greater, inoperable elevation relative to the ground surface than in the operative position for permitting access beneath the frame member during an initial start-up of the apparatus to deposit thereat a starting quantity of the paving material.

10. A slip-form paving apparatus according to claim 9, wherein the pavement forming means comprises a spreader means for distributing paving material across the forward side of the frame member.

11. A slip-form paving apparatus according to claim 9, wherein the pavement forming means comprises a strike-off member for generally leveling the pavement material on the ground surface.

12. A slip-form paving apparatus according to claim 11, wherein the strike-off member comprises an edge disposed in the operative position at a predetermined elevation with respect to the ground surface to be paved.

13. A slip-form paving apparatus according to claim 12, wherein the strike-off member comprises a strike-off plate member essentially vertically disposed with a depending extent of the plate member forming the edge laterally with respect to the frame member.

14. A slip-form paving apparatus according to claim 9, wherein the pavement forming means comprises an auger member for distributing paving material across the forward side of the frame member and a strike-off member for generally leveling the pavement material on the ground surface, the auger member and the strike-off member being joined for unitary movement between the inoperative and operative positions.

15. A slip-form paving apparatus according to claim 14, wherein the auger member and the strike-off member are integrally mounted pivotably to the frame member for pivoting movement between the inoperative and operative position.

16. A slip-form paving apparatus according to claim 9, wherein the pavement forming means is supported pivotably on the frame member for pivoting movement between the inoperative and operative positions.

* * * * *